US007761953B2

(12) United States Patent
Dalton

(10) Patent No.: US 7,761,953 B2
(45) Date of Patent: Jul. 27, 2010

(54) MOP BUCKET BAG INSERT

(76) Inventor: Steve Dalton, 346 Foxcroft Dr., Blue Ridge, VA (US) 24064

( * ) Notice: Subject to any disclaimer, the term of this patent is extended or adjusted under 35 U.S.C. 154(b) by 408 days.

(21) Appl. No.: 11/487,662

(22) Filed: Jul. 17, 2006

(65) Prior Publication Data

US 2007/0022559 A1 Feb. 1, 2007

Related U.S. Application Data

(60) Provisional application No. 60/702,854, filed on Jul. 28, 2005.

(51) Int. Cl.
*A47L 13/58* (2006.01)

(52) U.S. Cl. ..... 15/261; 15/260; 15/264

(58) Field of Classification Search ..... 15/260, 15/261, 264

See application file for complete search history.

(56) References Cited

U.S. PATENT DOCUMENTS 4,127,155 A * 11/1978 Hydorn ..... 383/26
4,268,392 A * 5/1981 Hayes ..... 210/238
4,343,053 A * 8/1982 O'Connor ..... 4/452
4,848,930 A * 7/1989 Williams et al. ..... 383/104
6,006,397 A * 12/1999 Williams et al. ..... 15/261
6,116,780 A * 9/2000 Young et al. ..... 383/44
D507,754 S * 7/2005 Lucas et al. ..... D9/704
6,991,373 B2 * 1/2006 Carr et al. ..... 383/111
2004/0066987 A1 * 4/2004 O'Neill ..... 383/75

* cited by examiner

*Primary Examiner*—Dung Van Nguyen
(74) *Attorney, Agent, or Firm*—Robert Pitts; Charles Y. Lackey

(57) ABSTRACT

An insert is provided for a mop bucket application to capture dirty water and/or clean water during floor mopping. The insert can be made of flexible PVC vinyl or of a similar substance giving the user the ability to quickly install the insert into a mop bucket. When the insert has collected the dirty water, the wringer can be quickly removed. Since the insert's bottom is flat, it will remain upright even when unsupported. The insert and contained dirty water can easily be removed by lifting the handles on the insert's two sides. The slick inside surface of the insert enables the dirty water to be poured with ease in a direct, substantially v-shaped stream. The structure of the insert preferably includes a body section which is connected at its two ends. A bottom portion forms a base for the body section, and side handles are affixed to the upper edge of the body section. A handle is secured to the outer side of the bottom portion.

19 Claims, 5 Drawing Sheets

MOP BUCKET BAG INSERT

This application is based on my provisional application No. U.S. 60/702,854 filed Jul. 28, 2005.

BACKGROUND OF THE INVENTION

The present invention relates to a bucket insert, and, more particularly, to an insert that can be utilized in most any mop bucket application to capture dirty excess water and/or clean water during the mopping procedure.

In a floor cleaning operation, a mop and mop bucket are usually involved. A wringer is typically mounted to a mop bucket to wring the liquid from a wet mop. During the cleaning operation, the mop is dipped into a washing liquid contained in the bucket and moved around the floor to remove dirt from the floor. To provide continuous cleaning, the mop must be wrung repeatedly with the wringer and rewetted by dipping it into the washing liquid. The dirty liquid squeezed from the mop conventionally is returned to the clean washing liquid. Thus, the washing liquid in the bucket is quickly contaminated.

Devices have been developed to overcome this disadvantage. One of the reference discloses a device for collecting dirty washing liquid and for containing clean liquid for wetting a floor cloth for washing floors. The device includes a main container which supports a wringer and defines a compartment for collecting the liquid produced by wringing the floor cloth, and a secondary container or insert which is mounted to the top portion within the main container and contains clean washing liquid for wetting the floor cloth. Thus, the clean washing liquid is separated from the dirty liquid contained in the main container.

Although this device provides the advantage of separating the dirty fluid from the clean fluid, it has disadvantages. Because of its configuration, the insert can only fit certain buckets specifically designed to receive the insert. Because the insert is mounted to the top portion of the bucket and is used to contain the clean washing liquid, the entire system is not very stable when first commencing the cleaning process as the washing liquid contained by the insert tends to raise and off-center the center of the mass. Moreover, there is no room for keeping the mop because the insert is not deep enough and it is not desirable to keep the mop in the dirty liquid of the main container.

Another prior art reference discloses a bucket having reservoirs for segregating the clean washing liquid from dirty washing liquid. The bucket contains a discharge transfer compartment with holes in its bottom wall for wringing a mop and draining the dirty liquid into a discharge storage reservoir which is located beneath the discharge transfer compartment and occupies the whole lower portion of the bucket. The floors of the discharge transfer compartment and the clean liquid reservoir are shaped with adequate slope or curvature so that the particulate material discharged from a mop is caused to move to the lowest point for removal. This bucket however does not use a disposable insert. Instead, a discharge transfer compartment and a discharge storage reservoir are used. Because they are fixedly mounted and contain holes and curvatures, it is not convenient to clean the bucket.

Yet another reference discloses a bucket provided with a squeeze plate for squeezing a sponge mop. The bucket has an inner bucket for containing clean washing liquid and a separate container for receiving a filter and the dirty liquid drained through the filter. The separate container or insert has a fixed size and shape determined by the dimensions of the filter and the squeeze plate, therefore it cannot be used for other types of buckets and mops.

Another reference discloses a pliable mop bucket insert that is pushed against the side walls of the bucket. The insert is removably attached to the bucket and used to collect the dirty liquid while the bucket contains the clean liquid. The entire insert is placed in the bucket thereby reducing the volume of liquid that can be used in the bucket and requiring the user to refill the bucket more frequently.

A recent reference provides a bucket insert having a container body with a lower and an upper portion, the upper portion having a larger volume than the lower portion. The lower portion of the bucket insert is inserted into a bucket and the upper portion is arranged to extend laterally over the lower portion and to receive a wringer device. This arrangement allows the insert to retain a larger volume while still not greatly reducing the volume of the wash bucket. The bucket insert includes a hook member operatively connected to the container body for connection to the bucket.

Thus there is perceived a need for a simple, practical, flexible and improved mop bucket insert that will allow clean water, when introduced, to push the insert toward the back of the mop bucket and, when dirty water is inserted therein, push the clear water back toward the front of the bucket. It is to this perceived need that the present invention is directed.

SUMMARY OF THE INVENTION

The invention is an insert that can be utilized in most mop bucket applications to capture dirty excess water and/or clean water during the mopping process. The insert can be made of flexible PVC vinyl or a similar substance giving the user the ability to quickly install the insert into a mop bucket. When the insert has collected the dirty water, the wringer can be quickly removed. Since the insert's bottom is flat, it will remain upright even when unsupported. The insert and carried dirty water can easily be removed by lifting the handles on the insert's two sides. The slick inside of the insert enables the dirty water to be poured with ease in a direct, substantially v-shaped stream.

The structure of the insert preferably includes a body section which is connected at each end. A bottom portion forms a base for the body section, and side handles are affixed to the upper edge of the body section. A handle is secured to the outer side of the bottom portion.

While the present invention has significant application to commercial and industrial structures, it can also be used, in another embodiment, in residential structures. Such an embodiment may include providing the insert with one or more fixed divider since only a limited amount of water is necessary and the insert can be used alone in a sink or other receptacle without need of a bucket.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and set forth in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed description taken in conjunction with the accompanying drawings wherein like characters of reference designate like parts throughout the several views.

The drawings are included to provide a further understanding of the invention and are incorporated in and constitute a part of this specification. They illustrate various embodiments of the invention and, together with their description, serve to explain the principles of the invention.

DETAILED DESCRIPTION OF PREFERRED EMBODIMENTS

Figure 1:
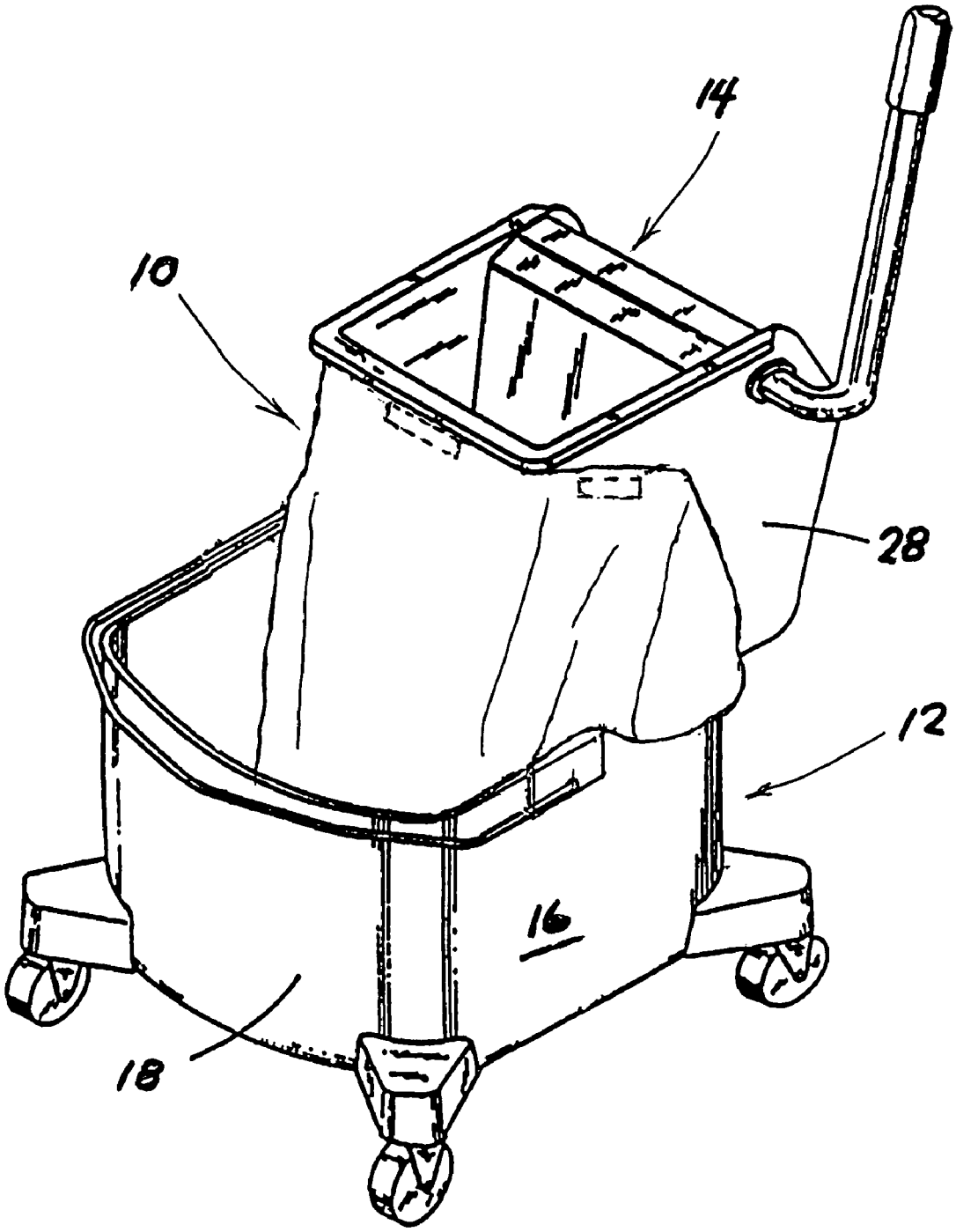
FIG. 1 is a perspective view of the bucket insert of the present invention illustrating the positioning of the insert within a convention mop bucket releasably secured to a standard mop wringing apparatus.
Figure 2:
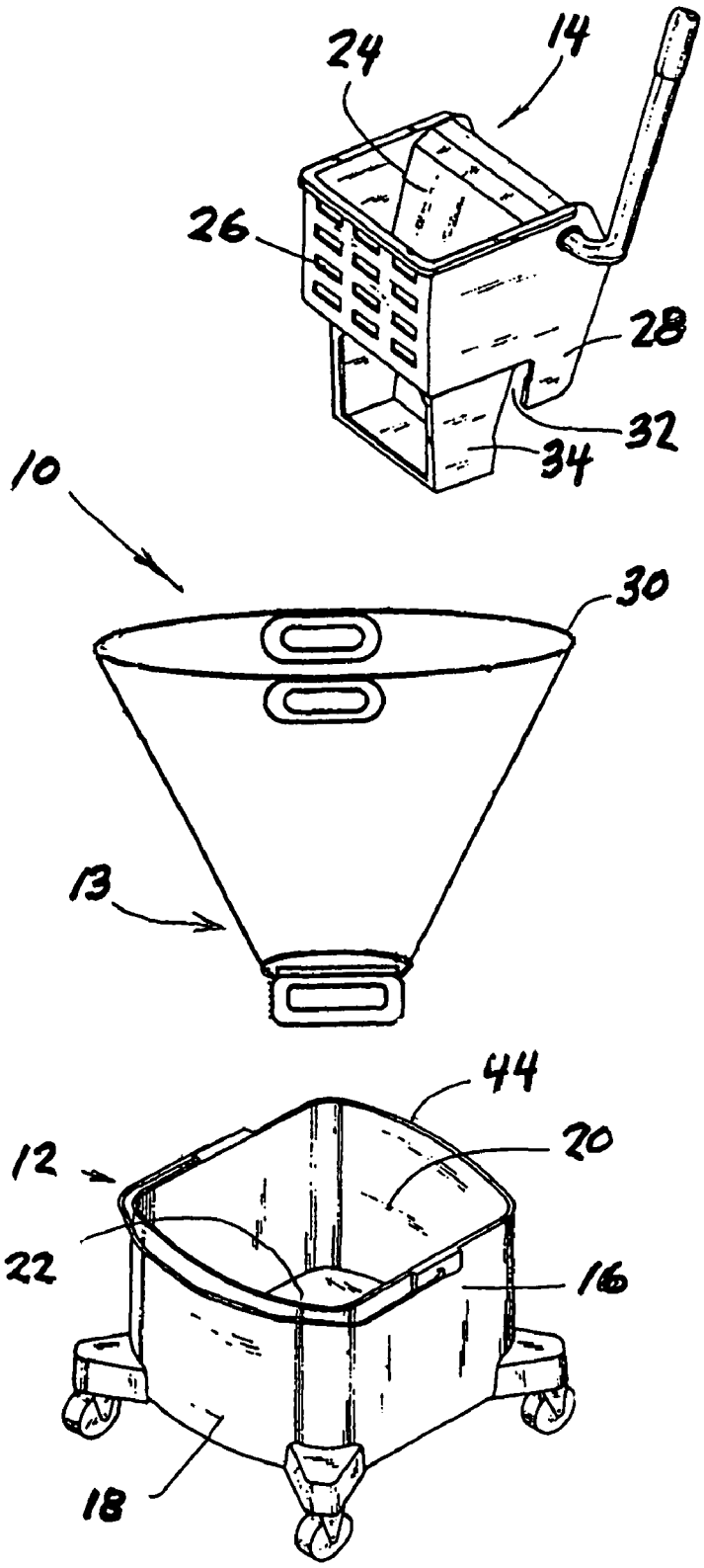
FIG. 2 is a perspective, exploded view of the bucket insert in combination with a conventional mop bucket and wringer apparatus.

Referring now to the drawings and particularly to FIG. 1, the bucket insert of the present invention designated generally as 10 is shown in combination with a mop bucket 12 and a wringer 14 of conventional construction. Bucket 12 has side walls 16, a front wall 18 and a back wall 20 enclosing a space 22 for holding washing liquid and receiving the lower portion 13 of insert 10. Wringer 14 has a compartment 24 for receiving and wringing dirty water from a mop through small openings 26. Wringer 14 is connected to insert 10 by a support portion 28 with back wall 20 and insert edge 30 placed in the gap 32 formed between the lower portion 34 of wringer 14 and support portion 28.

Insert 10 can be made of flexible PVC vinyl or a similar product which gives the user the ability to quickly install insert 10 into mop bucket 12. After the dirty water is collected in insert 10, wringer 14 can quickly be removed. Because of the flat bottom 42 of insert 10, it will remain upright even when unsupported. The contained dirty water will pour easily because of the slick finish of the inside of insert 10 and come out in a direct stream through the formed V's 36 in edge 30. The slick finish eliminates most cleaning of insert 10 after dumping dirty water. Insert 10 has the needed flexibility to allow clean water to push the bag towards the back of mop bucket 12. When dirty water is squeezed into insert 10, it pushes the clear water back toward the front of bucket 12.

Reinforced handles 60 are placed on each side of insert 10 (FIG. 3) for easy pick up and distribution of dirty water into a sink or disposal area. A centrally located handle 58 is positioned on bottom 42 providing easy access and balance while dumping dirty water.

Hook and loop fasteners, self-lock mushroom head fasteners or any other product of like function are put on the sides and front of wringer 14 as shown in FIG. 1 so that the discharge portion of wringer 14 is completely enclosed. The fasteners may vary in size depending upon the size of bucket 12 and wringer 14. Creating the enclosure described prevents any water splash when wringing out the mop. Using the fasteners enables fastening insert 10 to wringer 14 at the most desired locations to ensure maximum securement and minimum water spill.

When installing insert 10, edge 30 flips over the lip 44 of bucket 12 so that when wringer 14 is placed over insert 10, it will stay in place and not move because of the weight of wringer 14. The flexibility of the sides of insert 10 enables it to fit most mop bucket applications.

While usually used as a single unit with each mop bucket application, two inserts 10 can be used at once, one for clean water and one under the wringer outlet for dirty water as previously described. This is convenient when there is some distance between the area of floor cleaning and the clean water source, and moving bucket 12 to the water source can be cumbersome.

Figure 4:
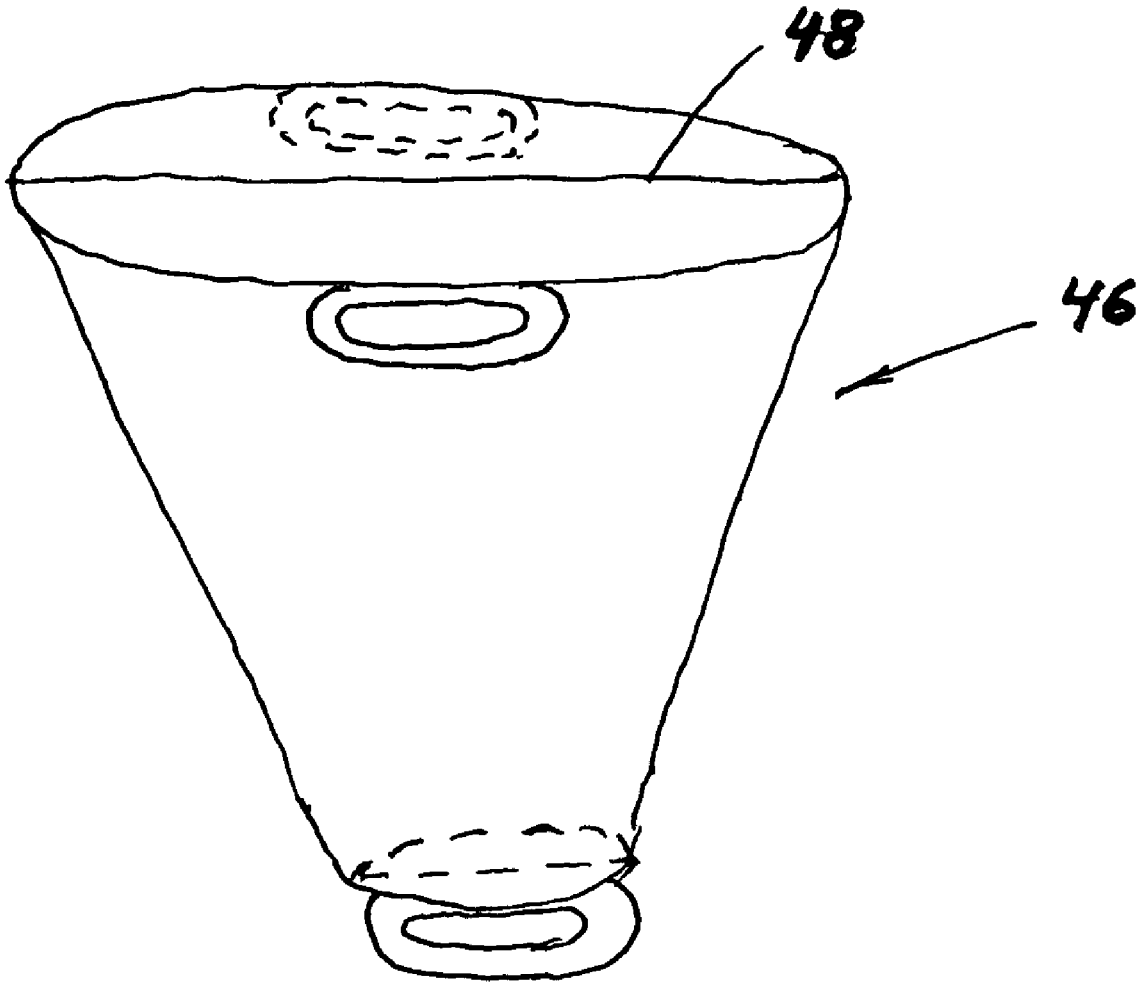
FIG. 4 is a perspective view of an alternative embodiment of the bucket insert comprising the present invention.
Figure 5:
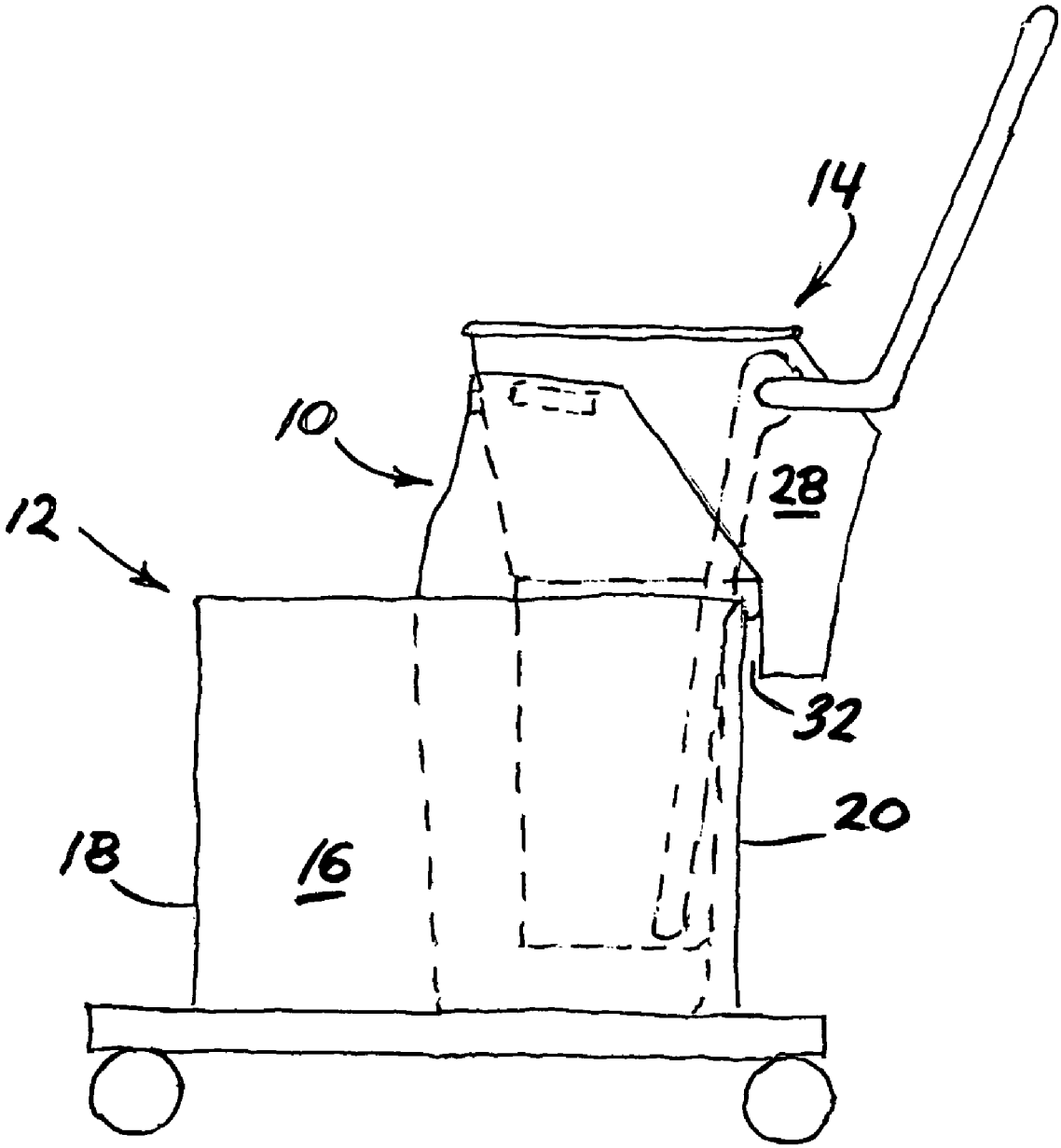
FIG. 5 is a side elevational, sectional view of the bucket insert comprising the present invention.

Another embodiment of the present invention includes the use of a compartmentalized insert 46 (FIG. 4). Here, a divider 48 is formed in insert 46 to separate dirty and clean water. This embodiment is well suited for residential floor cleaning situations and small commercial and industrial floor areas. Here only a limited amount of water will be needed. Insert 46 can stand on its own, be placed in a bucket or positioned in a sink to help separate the dirty and clean water. When a user cleans their mop after use, it is desired to place the mop in clear clean water immediately so that more dirt will wash out when wrung out. Divider insert 46 enables the placement of a dirty mop in one side of clean water insert 46, wring out the dirty water and place it in the second side of clean water insert 46 where the clean water is cleaner and better results will be achieved.

Figure 3:
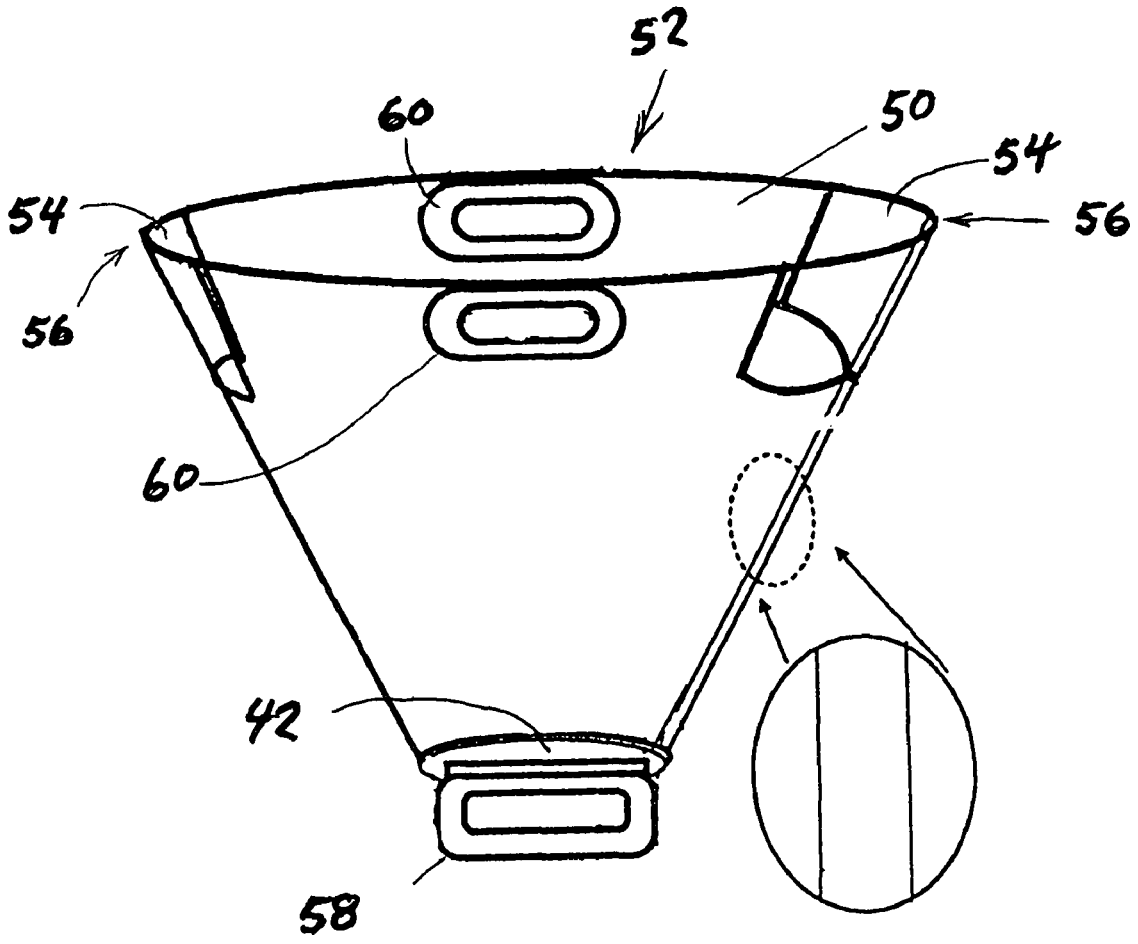
FIG. 3 is a side perspective and schematic view of the bucket insert comprising the present invention.

Insert 10 is formed of a body section 50 which is overlappingly joined to form a conically shaped member 52 (FIG. 3). A second ply 54 of PVC vinyl or other suitable material is secured to body section 50 at the two natural fold areas 56 of edge 30, and these plys 54 are secured to body section 50 with heat sealed edges. Bottom portion 42 closes the smaller opening of member 52, and a bottom handle 58 is secured thereto. Lifting handles 60 are secured to member 52 along edge 30.

From the preceding description, it can be seen that a mop bucket device for separately receiving dirty washing liquid and containing clean washing liquid has been provided that will meet all of the advantages of prior art devices and offer additional advantages not heretofore achievable. With respect to the foregoing invention, the optimum dimensions the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. An apparatus for collecting dirty washing liquid from a mop comprising: a mop bucket having front, back and side retaining walls for retaining clean washing liquid; a wringer having a mop and dirty water receiving compartment and an actuating lever, the wringer being mountable on the mop bucket; a flexible insert having an upper opening defined by an edge and a lower opening closed by a bottom, the flexible insert being shapable to fit within and be secured to the mop bucket, the wringer with the dirty water receiving compartment engaging the flexible insert along the insert upper opening edge at a first insert upper opening edge location and at least one mop bucket retaining wall engaging the insert upper opening edge at a second insert upper opening edge location so that the insert is attachable to both the mop bucket and the wringer; and releasably securing means securing the insert upper opening edge to the wringer, the actuating lever operable to activate the wringer, to extract dirty water from the mop and direct the dirty water to the flexible insert.

2. The apparatus as claimed in claim 1 wherein the insert is variable in size.

3. The apparatus as claimed in claim 2 wherein the insert has at least one compartment.

4. The apparatus as claimed in claim 2 wherein the insert is replaceable.

5. The apparatus as claimed in claim 2 wherein the insert has at least one handle.

6. The apparatus as claimed in claim 2 wherein the insert is engaged by the wringer at the second location on the insert upper opening edge.

7. The apparatus as claimed in claim 2 wherein the insert has at least one lifting handle.

8. The apparatus as claimed in claim 2 wherein the insert has at least one lifting handle and one directing handle.

9. The apparatus as claimed in claim 2 wherein the insert is reusable.

10. The apparatus as claimed in claim 1 wherein the insert has at least one compartment.

11. The apparatus as claimed in claim 10 wherein the insert is reusable.

12. The apparatus as claimed in claim 1 wherein the insert is replaceable.

13. The apparatus as claimed in claim 1 wherein the insert has at least one handle.

14. The apparatus as claimed in claim 1 wherein the insert is engaged by the wringer at the second location on the insert upper opening edge.

15. The apparatus as claimed in claim 1 further comprising: an additional flexible insert positioned within the mop bucket for retaining clear washing liquid.

16. The apparatus as claimed in claim 1 wherein the insert is usably freestandable separate and apart from the mop bucket and wringer.

17. The apparatus as claimed in claim 1 wherein the insert is reusable.

18. A bag suitable for use with a mop bucket and wringer for collecting dirty water, the bag being insertable in a mop bucket, the bag comprising:

conical sides extending between an upwardly open edge and a closed flat bottom, the bag being flexible so that the bag will expand as additional water is deposited into the bag, the bag being capable of freestanding, without collapse of the conical sides when supported by the flat bottom, the conical sides also being sufficiently flexible so that upper sections of the bag can be folded outwardly over a lip of a mop bucket in which the bag is placed, the bag having a sufficient volume so that lower portions of a wringer on the mop bucket can be inserted into the bag;

at least one upper handle adjacent the upwardly open edge of the bag so that the bag can be lifted out of a mop bucket to dispose of dirty water collected within the bag; and fasteners on the bag, the fasteners being attachable to complementary fasteners on the wringer to secure one side of the bag to the wringer without dislodging the upper sections of the bag folded over the lip of the mop bucket, the fasteners also being detachable from complementary fasteners so that the at least one upper handle can be grasped for removing the bag from the mop bucket to dispose of the dirty water, wherein the bag also includes a bottom handle extending from the flat bottom of the bag so that a user can grasp both the upper handle and the bottom handle to dispose of dirty water collected in the bag.

19. A bag suitable for use with a mop bucket and wringer for collecting dirty water, the bag being insertable in a mop bucket, the bag comprising:

conical sides extending between an upwardly open edge and a closed flat bottom, the bag being flexible so that the bag will expand as additional water is deposited into the bag, the bag being capable of freestanding, without collapse of the conical sides when supported by the flat bottom, the conical sides also being sufficiently flexible so that upper sections of the bag can be folded over a lip of a mop bucket in which the bag is placed, the bag having a sufficient volume so that lower portions of a wringer on the mop bucket can be inserted into the bag;

at least one upper handle adjacent the upwardly open edge of the bag so that the bag can be lifted out of a mop bucket to dispose of dirty water collected within the bag; and fasteners on the bag, the fasteners being attachable to complementary fasteners on the wringer to secure one side of the bag to the wringer without dislodging the upper sections of the bag folded outwardly over the lip of the mop bucket, the fasteners also being detachable from complementary fasteners so that the at least one upper handle can be grasped for removing the bag from the mop bucket to dispose of the dirty water wherein the bag includes a central wall to divide the bag into two compartments, both capable of holding water, so that clean and dirty water can be separately contained within the bag.

* * * * *